US009278293B1

(12) United States Patent
Healy

(10) Patent No.: US 9,278,293 B1
(45) Date of Patent: Mar. 8, 2016

(54) ASSEMBLING PLUSH ITEMS

(71) Applicant: Thomas Healy, Indianola, WA (US)

(72) Inventor: Thomas Healy, Indianola, WA (US)

( * ) Notice: Subject to any disclaimer, the term of this patent is extended or adjusted under 35 U.S.C. 154(b) by 0 days.

(21) Appl. No.: 14/517,799

(22) Filed: Oct. 18, 2014

(51) Int. Cl.
*A63H 3/02* (2006.01)

(52) U.S. Cl.
CPC ..... *A63H 3/02* (2013.01)

(58) Field of Classification Search
USPC ..... 446/268, 369, 371, 491; 428/17, 24; 434/81, 82, 93; D21/496, 628
See application file for complete search history.

(56) References Cited

U.S. PATENT DOCUMENTS 769,935 A * 9/1904 Brom ..... A63H 3/18 124/16
D62,808 S * 7/1923 Wood ..... D21/628
D74,720 S * 3/1928 Cormany ..... D21/628
1,778,670 A * 10/1930 Herbison ..... A63H 3/04 446/370
3,471,964 A * 10/1969 Cherry ..... A63H 3/50 428/24
3,597,877 A * 8/1971 Speers ..... A63H 33/00 428/24
4,795,398 A * 1/1989 Wexler ..... A63H 3/003 428/24
5,093,947 A * 3/1992 Henegar ..... A47G 9/083 5/413 R
6,386,761 B1 * 5/2002 Bohnsack ..... A45C 3/00 383/24
6,532,613 B2 * 3/2003 Berry, IV ..... A47C 3/16 5/654
D510,400 S * 10/2005 Rockstad ..... D21/808
D643,589 S * 8/2011 Malcolm ..... D2/610
8,225,441 B2 * 7/2012 Heroux ..... A47G 9/10 5/636
8,684,782 B2 * 4/2014 Fiore ..... A63H 33/004 446/268
9,061,219 B2 * 6/2015 Fiore ..... A63H 33/004
2005/0106988 A1 * 5/2005 Feld ..... A63H 3/16 446/73
2005/0112300 A1 * 5/2005 Hughes ..... A41G 1/001 428/17
2005/0260547 A1 * 11/2005 Moody ..... G09B 1/04 434/176
2007/0232186 A1 * 10/2007 Shamah ..... A63H 3/005 446/369
2009/0176437 A1 * 7/2009 Jaqua ..... A63H 3/16 446/71
2012/0003899 A1 * 1/2012 Wallace ..... A63H 33/003 446/268
2012/0311779 A1 * 12/2012 Morelock ..... A47K 3/127 4/572.1
2013/0081963 A1 * 4/2013 Anderson ..... A63H 3/005 206/232

* cited by examiner

*Primary Examiner* — Kurt Fernstrom
(74) *Attorney, Agent, or Firm* — John Chandler

(57) ABSTRACT

Systems, apparatuses and methods are described for assembling items made of fabric and other sheet materials such as plastics, fur, artificial fur, canvas, etc. In particular, the invention relates to forming plush replicas of plants, artificial plants, animals, mythical creatures, mascots and the like. For example, squares or other shapes are assembled into square pillows; pillows are assembled into triplets or other groupings; and the groupings are assembled into a larger item. A Grouping or assembly of pockets can be installed or mounted onto a stem or post. Replicas may include forms of *Cannabis sativa, Cannabis indica*, Christmas trees, wreaths, poinsettias, foxes, owls, whales, and the like.

20 Claims, 12 Drawing Sheets

ASSEMBLING PLUSH ITEMS

BACKGROUND OF THE INVENTION

1. Field

The present invention relates to systems, apparatuses and methods for assembling items made of fabric or other sheet-based materials such as plastics, fur, artificial fur, canvas, etc. In particular, the invention relates to forming plush replicas of plants, artificial plants, animals, mythical creatures, mascots and the like.

2. Related Art

Various fuzzy, plush, stuffed and fabric-based items have been created for many decades. One popular item in the early twentieth century was the teddy bear: a soft and stuffed toy sewn with fabric with a thick pile and formed to look like a bear. It was named after U.S. President Theodore "Teddy" Roosevelt, Jr. The teddy bear has been the subject of story, song and film. Further, teddy bears and other plush animals and other forms have become popular gifts for children and adults alike. Teddy bears and other cute creatures are often given to signify love, congratulations or sympathy. These plush creations have become part of the American culture and can be found in many online and brick-and-mortar retail outlets throughout the world.

American culture also has come to embrace aspects of the *Cannabis* sub-culture. A significant minority of America celebrates a small genre of films known as stoner films and is responsible for introducing pot paraphernalia and slang into the mainstream lexicography. In the U.S., the *Cannabis* sub-culture has its own celebrities, magazines, holidays and the like. Even in some states, *Cannabis* possession has become legalized.

It is at the intersection of the plush toy and *Cannabis* culture that the instant invention has its genesis. Improved systems, apparatuses and methods are described herein for creating and assembling plush items. One item illustrated is a replica of a *Cannabis* plant, an item familiar to those of the *Cannabis* culture. However, the teachings are not so limited, and the teachings from the invention described herein may be used in a variety of arts.

SUMMARY

Embodiments and techniques described herein include improved systems, apparatuses and methods for creating components of plush items. Illustrated is construction of components of a replica of a *Cannabis* plant and for assembling the components into a finished item.

According to a first illustration, a square of plush fabric is folded and stitched to form a plush square with four plush subsections. Each subsection (e.g., nub, bulb or bud) forms the buds emanating from a central stock. Several squares are created. Ornamental strings are attached to the corners of the squares. Three squares are assembled into a triplet. Several triplets are formed. A stem, core or stock is formed by coating a tube or pipe. The tube or pipe may be made of an expanded polypropylene foam or other flexible material. The triplets are assembled onto the core or stock by nesting one triplet inside of another. The triplets are anchored to the core. A finished product includes these and other steps including making aesthetic adjustments as necessary to obtain a final product with desired properties and characteristics.

This Summary is provided to introduce a selection of concepts in a simplified form that are further described below in the Detailed Description. This Summary is not intended to identify key or essential features of the claimed subject matter, and thus the Summary is not intended to be used to limit the scope of the claimed subject matter.

BRIEF DESCRIPTION OF THE DRAWINGS

While the appended claims set forth the features of the present invention with particularity, the invention, together with its objects and advantages, will be more readily appreciated from the following detailed description, taken in conjunction with the accompanying drawings. Throughout, like numerals refer to like parts. Unless indicated to the contrary, the drawings and components therein are not drawn to scale overall and relative to one another.

DETAILED DESCRIPTION

Embodiments and techniques described herein include improved systems, apparatuses and methods for creating components of plush items. Illustrated is construction of components of a replica of a *Cannabis* plant and for assembling the components into a finished item.

Briefly, the following is a first illustration of a method of assembly of an illustrative plush item. A square of plush fabric is folded and stitched to form a plush square with four plush subsections. Each subsection (e.g., nub, bulb or bud) forms the buds emanating from a separately created central stock or stem. Several squares are created. Ornamental strings are attached to the corners of the squares. Three squares are assembled into a triplet. Several triplets are formed. The triplets are assembled onto a core or stock by nesting one triplet inside of another and anchoring the triplets to stem. A finished product may include other steps including making aesthetic adjustments as necessary to obtain a final product with desired properties and characteristics.

Figure 1:
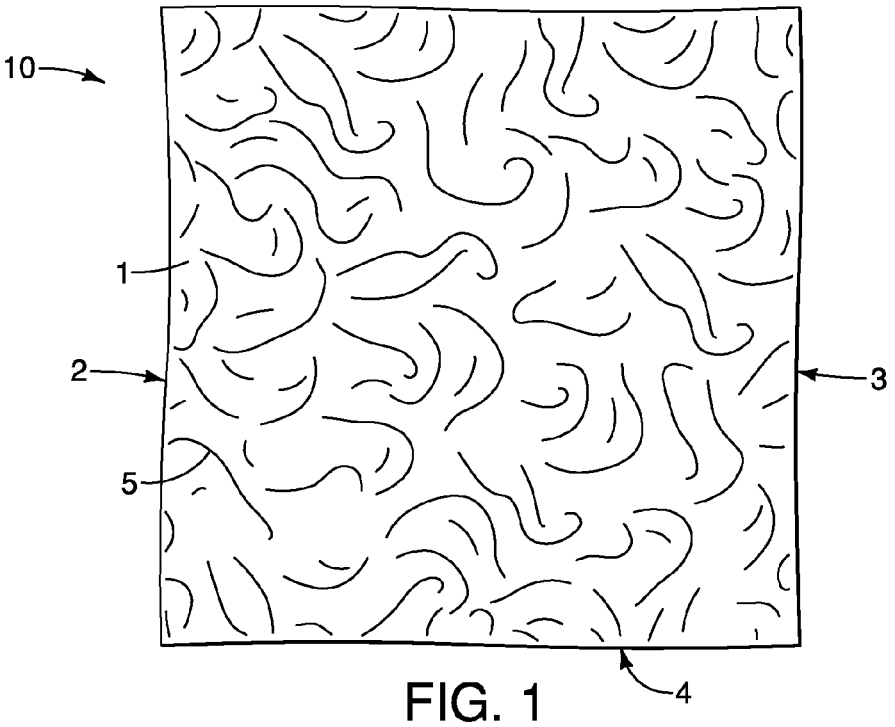
FIG. 1 illustrates an overhead view of a piece of cloth according to a first embodiment.

A series of figures are presented and described. The following describes a series of figures that illustrate the process for making a plush item. FIG. 1 illustrates an overhead view of a piece of cloth according to a first embodiment. Throughout this document, the piece of cloth is generally referenced as item 10. The piece of cloth is preferably made from an industrially produced fabric but may be formed from handmade processes such as knitting and the like. With reference to FIG. 1, a piece of cloth 10 includes a first generally planar side 1 and a second generally planar side 2. The piece of cloth 10 also has at least a first edge or dimension 3 and a second edge or dimension 4. While a square starting shape is shown for the cloth 10, other starting shapes are possible such as triangles, pentagons, hexagons, etc. The starting shape and subsequent treatment (e.g., folding, stitching and assembly) determine many of the characteristics of the final plush item. With reference to FIG. 1, the first side 1 may include a texture 5 or other elements that are distinct from a texture or other elements of the second side 2.

The starting materials for a finished, small plush *cannabis* pillow include six squares of green fabric that are approximately one-foot by one-foot in dimension at the start such as shown in FIG. 1. Further, the starting materials include: 24 four-inch lengths of copper-colored embroidery floss, fabric leaves of about two inches in their longest (length) dimension, one 12-inch by 1⅜ inch polyvinyl chloride (PVC) insulator foam piece, green nylon thread, and polyester stuffing.

The starting materials for a large plush *cannabis* pillow include 12 squares of green fabric that are approximately one-foot by one-foot in dimension. According to a first illustrative example, the cloth 10 is made of a green fabric having a thick and soft pile. One such fabric is a commercially available minky rose cuddle olive ("MRCO") fabric that forms a green color reminiscent of a *Cannabis* plant. The MRCO fabric has a thick pile which lends itself to a soft or feathery tactile sensation. The starting materials also include 48 four-inch lengths of copper-colored embroidery floss, and 12 fabric leaves of about two inches in their longest (length) dimension. The starting materials also include one 24-inch by 1⅜ inch polyvinyl chloride (PVC) insulator foam. Green nylon thread is used along with a polyester stuffing used for stuffing certain assembled pieces as described in more detail herein.

Figure 2:
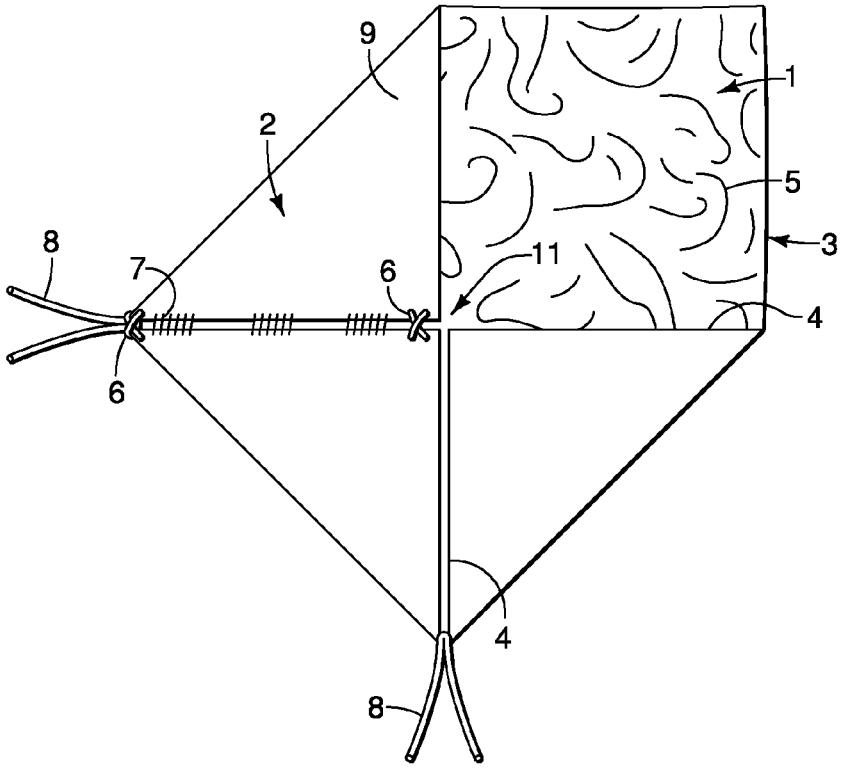
FIG. 2 illustrates an overhead view of a partially assembled pillow made from the piece of cloth shown in FIG. 1.

FIG. 2 illustrates an overhead view of a partially assembled, partially-stitched (inside out) pillowed component made from the piece of cloth 10 shown in FIG. 1. With reference to FIG. 2, one of the four corners has been left unfolded. FIG. 2 illustrates how a cloth 10 can be stitched. A back side or second side 2 with a less feathery or unfinished texture 9 is visible. Preferably, each corner is folded toward a center location 11. Each corner or folded portion includes a part of a first dimension 3 and a part of second dimension 4. The texture 5 of the first side 1 is visible on the unfolded corner. Starting and ending stitch indicators 6 define the ends of the stitch path 7 that can be taken when stitching together the edges 3, 4 of the cloth 10. Only a single stitch path 7 is shown for sake of simplicity of illustration in FIG. 2. Ornamental strings or threads 8 are added to each corner of the square 10. Any of various kinds of ornamentation can be added during sewing and assembly of the plush item. According to one implementation, a copper-colored embroidery floss is used for the strings 8. However, white, green or red strings 8 may be used.

Figure 3:
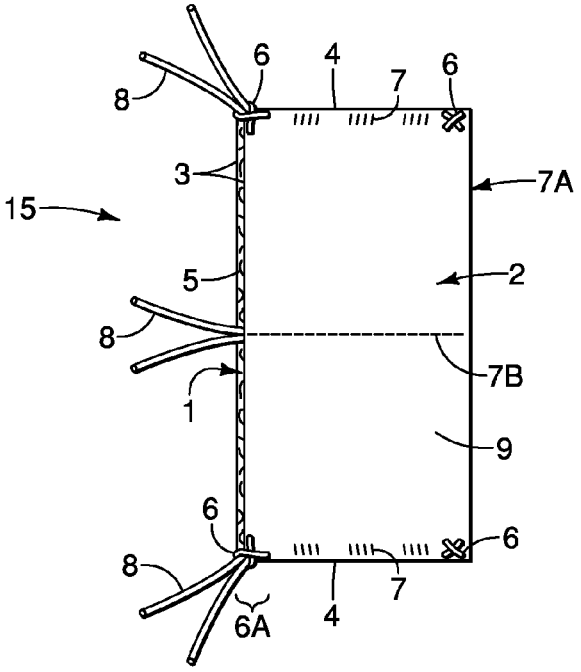
FIG. 3 illustrates the partially assembled pillow shown in FIG. 2 in a sewing configuration.

FIG. 3 illustrates the partially sewn square 15 shown in FIG. 2 in a first sewing configuration. With reference to FIG. 3, a sewing person would match up opposing edges 3 by folding the cloth 10 along a first folding line 7A and would sew along second edges 4 as indicated by the stitch paths 7. For example, sewing could start and end at the indicated stitch indicators 6. In this way, two of the four stitch paths 7 could be easily and rapidly accomplished. The other two of four stitching paths (not shown) could be accomplished by folding the cloth 10 along a second sewing folding line 7B indicated by the dashed line. Note that stitching is preferably made up to the folding line 7A, but stitching is avoided near the first edges 3 as indicated by the regions 6A. These regions 6A provide a means (as shown and described with relation to other figures herein) for inserting stuffing into the substantially enclosed square 15. The unfinished texture 9 of the second side is visible on the outside of the second side 2. According to an illustrative technique, any stitching, when the square 15 is finished, would be folded toward the inside of the finished square 15 and thus the seam sewn along line 7 would be hidden from view. The texture 5 of side 1 is visible for sake of illustration to show that portions of side 1 are folded to the inside of the square 15 shown in FIG. 3.

Figure 4:
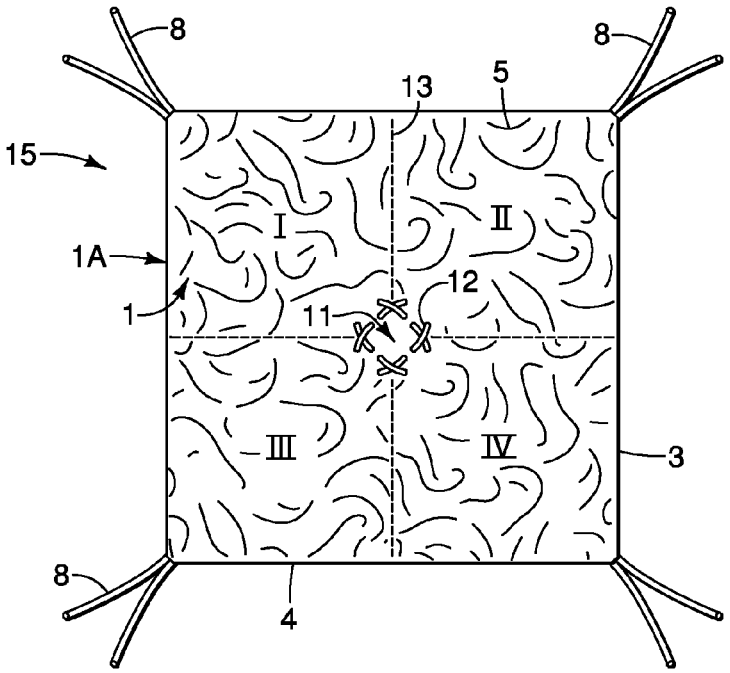
FIG. 4 illustrates an overhead view of a fully assembled pillow square made from the piece of cloth shown in FIG. 1.

FIG. 4 illustrates an overhead view of a fully assembled pillow or square 15 made from the piece of cloth shown in FIG. 1. The texture 5 of side 1 is visible over the surface of the square 15. The texture 5 covers the exterior of the square 15 on the outside sides 1, 1A. Threads 8 have been added to each of the corners. Stitching to attach the threads 8 would be folded inside the square 15 when the square 15 is turned right-side out—as shown in FIG. 4. The square 15 has been stuffed with stuffing such as a non-combustible, commercially reasonable stuffing, padding or batting. Such stuffing could be a natural or artificial stuffing. Examples of such stuffing include: foam, filament based stuffing, wool, feathers, polystyrene-based pellets, cloth pieces and beans. Preferably, the stuffing is something soft and at least somewhat resilient. Due to stitching indicated in FIG. 2 (along paths 7), a finished stitching 13 separates the square 15 into four quadrants, nubs, bulbs or buds indicated by roman numerals I, II, III, and IV. The batting is added to each quadrant of the square 15 via openings near the center 11. After being filled, the openings near the center 11 may be sewn shut as indicated by the stitching points 12. At this point in time during the assembly process, the square 15 is formed with a substantially linear first side 3 and a substantially linear second side 4.

Figure 5:
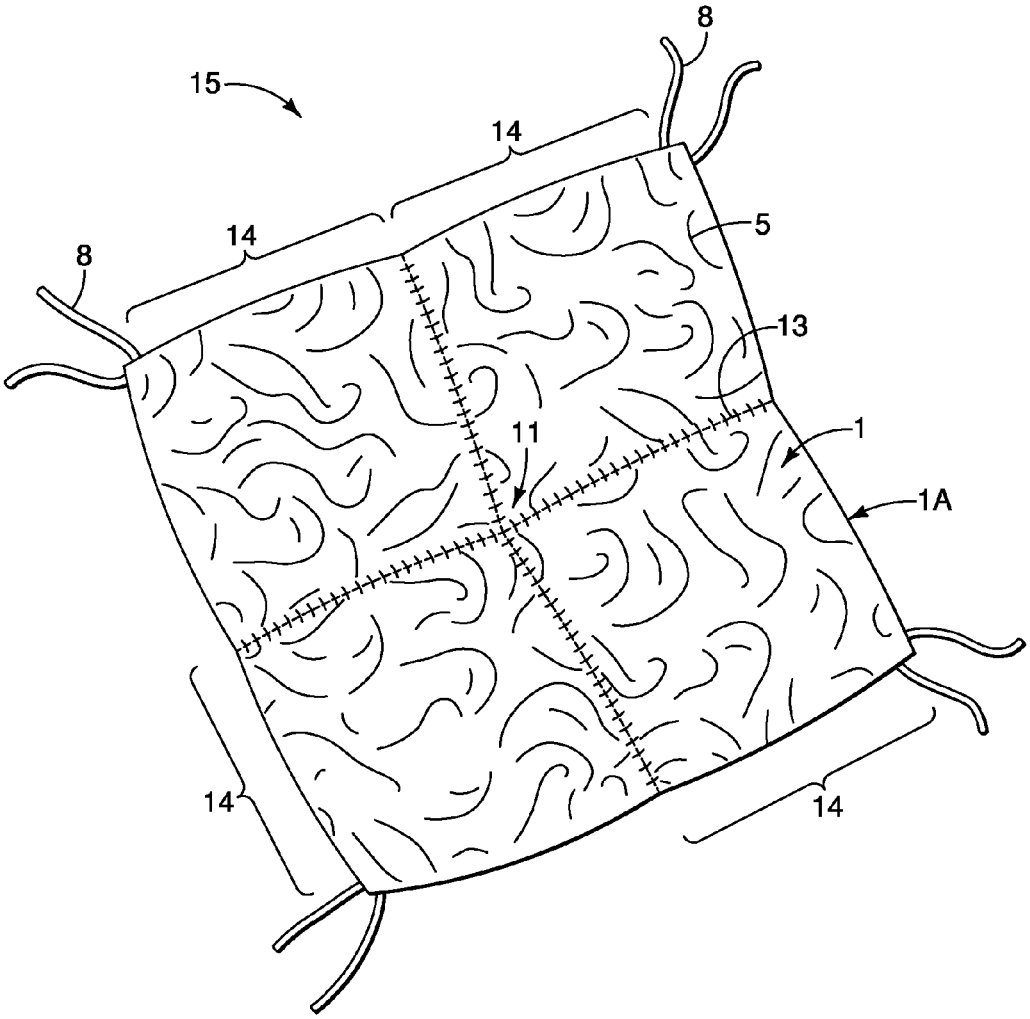
FIG. 5 illustrates a perspective view of a fully assembled pillow square made from the piece of cloth shown in FIG. 1.

FIG. 5 illustrates a perspective view of a fully assembled pillow square 15 made from the cloth shown in FIG. 1. A distinct texture 5 is visible on the exterior or exposed sides 1, 1A. The quadrants 14 are separated by the finished stitching 13. The center is visible at an intersection of the quadrants 14. Threads 8 are attached at the exterior corners of the quadrants 14. Several of the pillow squares 15 are needed before continuing with further steps in the assembly—shown in FIGS. 6-9.

Figure 6:
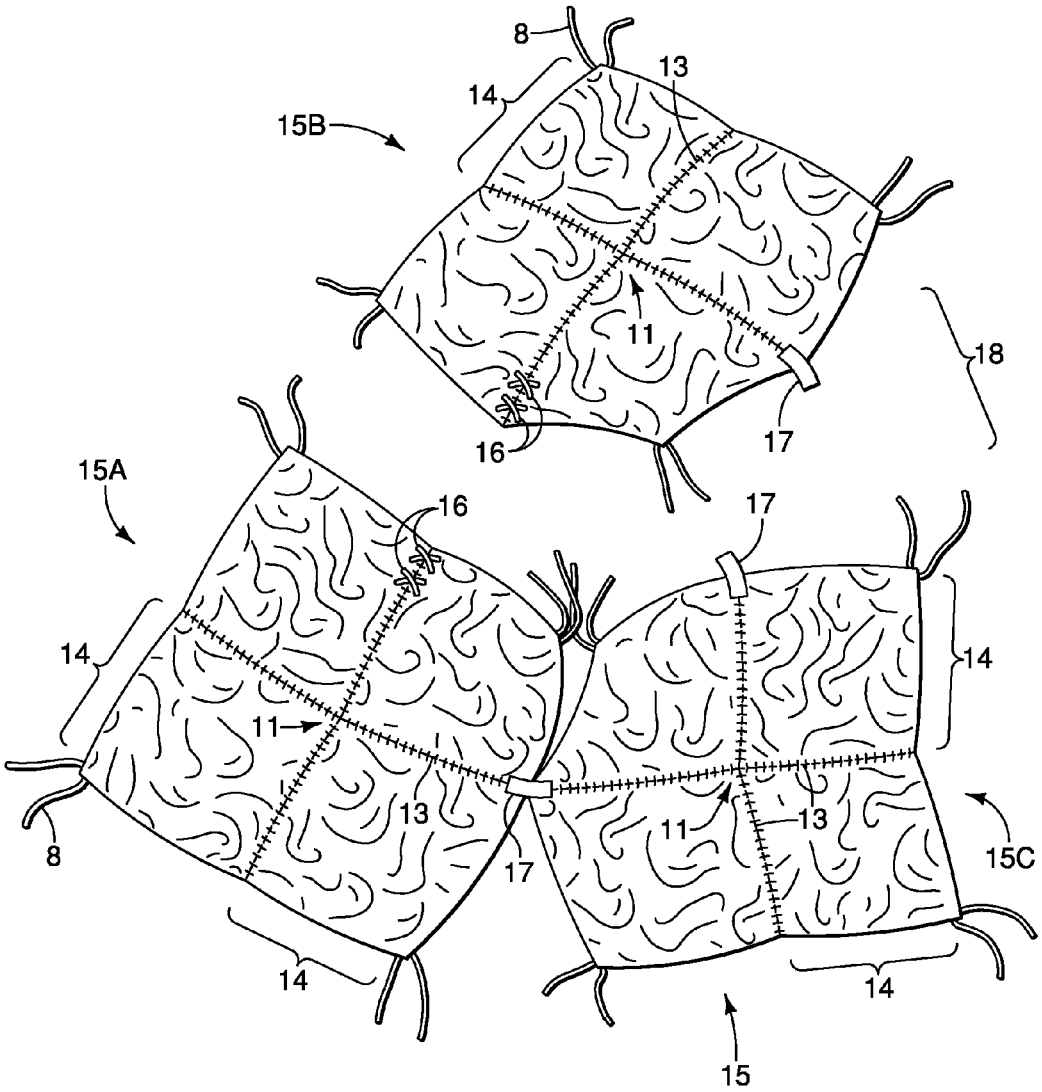
FIG. 6 illustrates a partially assembled triplet in a first configuration according to a first embodiment.

FIG. 6 illustrates a partially assembled "triplet" of squares 15 in a first configuration according to a first embodiment. The first configuration is a preliminary configuration in the assembly process. The first embodiment is shown for sake of illustration in forming the components of a finished pillow. Each of the squares 15A, 15B and 15C includes finished stitching 13 that divides each square into four quadrants or buds 14. The finished stitching 13 may intersect at a middle region 11 of each square 15. Accordingly, with each assembled triplet, twelve buds 14 are formed and added to a finished pillow. The quadrants 14 are shown as being of substantially equal size and shape but such is not required. Further, each square may be divided into other numbers or shapes of buds. Strings or filaments 8 are visible in the outer corner of each quadrant 14.

With reference to FIG. 6, a first square 15A is attached to a second square 15B at stitch points 16. The stitch points 16 may indicate single points of assembly if assembly is accomplished with snaps, rivets, plastic staples, or some other single-point attachment means. Alternatively, stitch points 16 indicate generally an area of bar tacking stitching 17 where stitching can be made to join adjacent squares together and reinforce the fabric at these points of contact. The bar tacking 17 is preferably done over the top or near a portion of the finished stitching 13 which allows for minimal disruption of the shape and other characteristics of the affected quadrants 14. The first square 15A is attached or sewn at a first area 16 to a first area 16 of the second square 15B. The first square 15A is also attached to a third square 15C at a region 17. The second square 15B is also attached to the third square 15C at a region 17. Thus, each square 15 is attached at a point or region to each of its two neighboring squares. For sake of illustration, a gap 18 is shown between adjacent squares 15B, 15C before these adjacent squares 15B, 15C are connected to each other.

Figure 7:
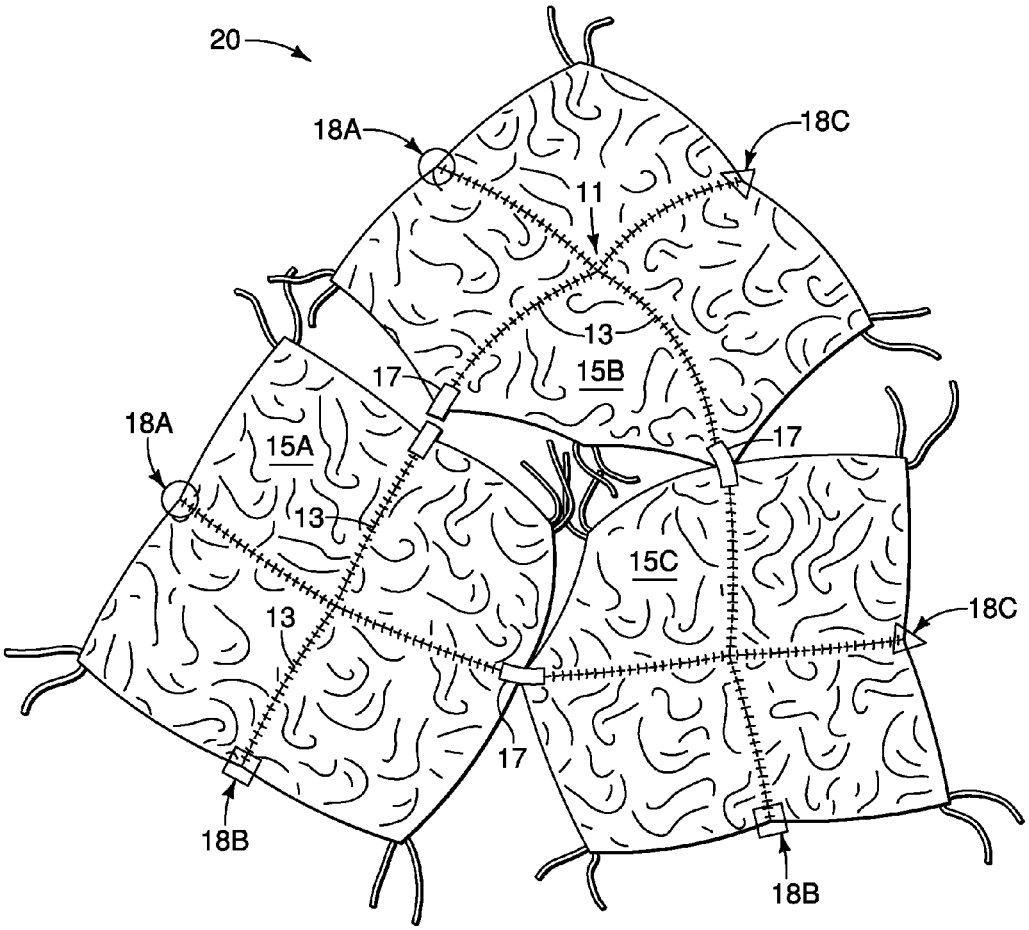
FIG. 7 illustrates a partially assembled triplet in a second configuration after three connections have been made between the pillows.

FIG. 7 illustrates a partially assembled triplet lying substantially flat and in a second configuration after three connections or bar tackings 17 have been completed between the squares 15A, 15B and 15C. From this configuration, three more connections or bar tackings will be made. Generally herein, a triplet of squares 15 is referred to as assembly 20 where adjacent squares 15 have been attached to each other. With reference to FIG. 7, a second set of connections 18 are to be made which connect two squares 15 together. Pairs of squares 15 are again attached to each other at or near a portion of a finished seam 13 so as to facilitate formation of bulbous buds 14. A first pair of bar tackings 18A is indicated in the first square 15A and the second square 15B with an open circle. A second pair of bar tackings 18B is indicated in the first square 15A and the third square 15C with an open square. A third pair of bar tackings 18C is indicated in the second square 15B and the third square 15C with an open triangle. The center 11 of each square 15A, 15B and 15C serve as points by which to manipulate each square to bend and fold so that appropriate bar tack regions may be mated together and stitched or attached. According to illustrative examples, the squares may be attached at the bar tacking regions 17 by stitching made by a sewing machine, or by snaps, rivets, plastic fasteners, metal fasteners, etc.

Figure 8:
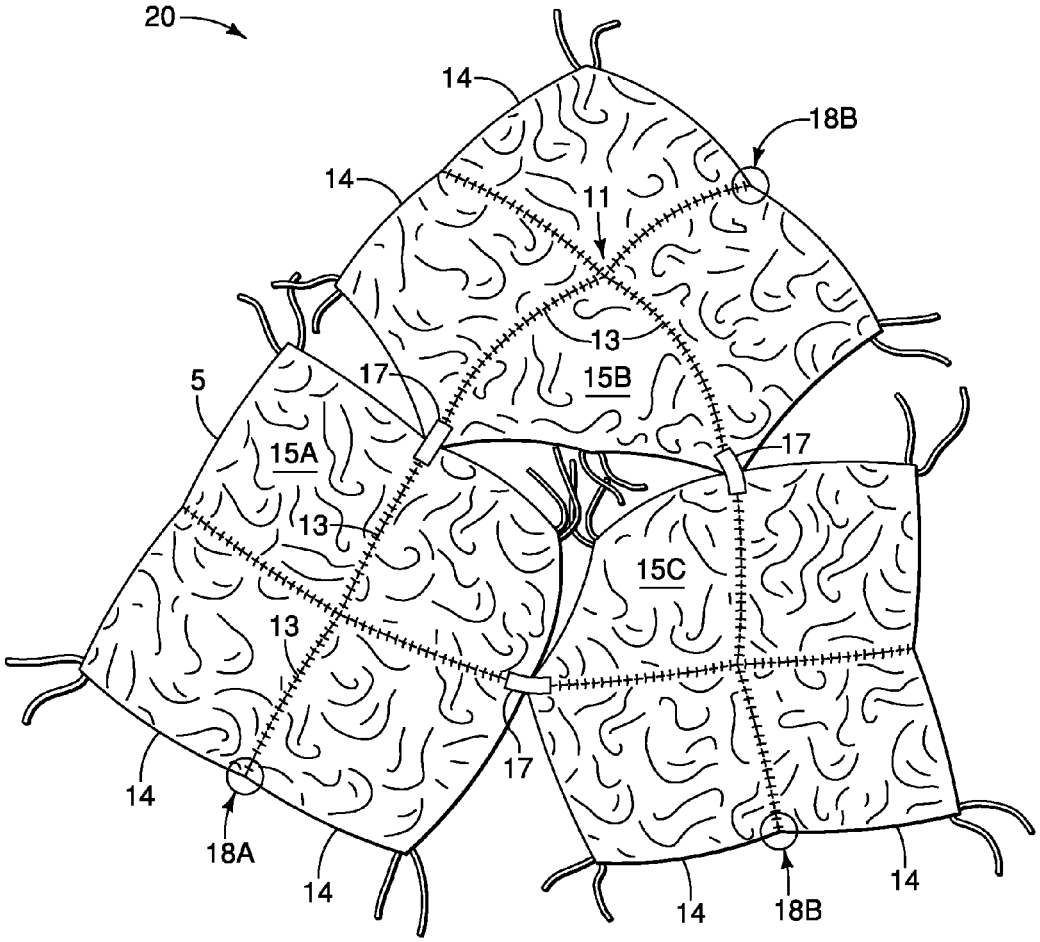
FIG. 8 illustrates a partially assembled triplet in a third configuration as a fourth connection is being made between the pillows.

FIG. 8 illustrates a partially assembled triplet 20 in a third configuration after four connections or bar stitchings have been made between the pillows. The first three connections or bar stitching 17 have been made as illustrated in FIGS. 6-7. Further, a first of three connections or bar stitchings 18 have been made—the positions being indicated in FIG. 7. With reference to FIG. 8, a first bar stitching or connection 18A has been completed between the first square 15A and the second square 15B. Next in time, two remaining bar stitchings 18B and 18C are to be made. In total, six bar stitchings 17, 18 are to be made in the assembled triplet 20—shown in FIG. 9. The texture 5 is visible on each quadrant or bud 14. The center 11 of each square 15A, 15B and 15C are visible and may serve as places by which to manipulate each square; that is, to bend and fold the squares 15A, 15B and 15C so that appropriate bar tack or sewing or connecting regions may be mated or connected together. Such connections are preferably made as permanent as possible such as with strong stitching, but may be made with temporary stitching, hook-and-loop fasteners and the like, in other embodiments.

Figure 9:
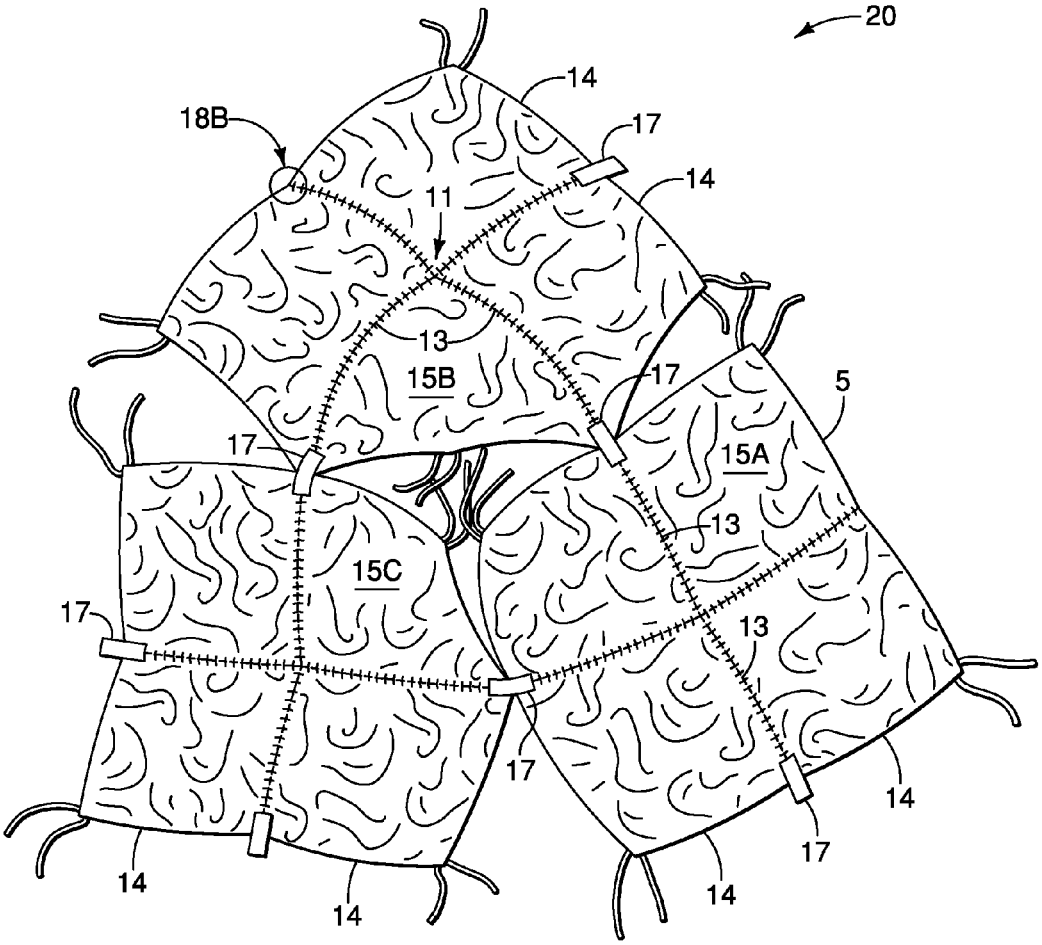
FIG. 9 illustrates a fully assembled triplet in a fourth configuration indicating six connections made between the pillows.

FIG. 9 illustrates a fully assembled triplet 20 in a fourth configuration after six connections have been made between the squares. The connections or bar stitchings 17 are indicated. The quadrants, buds or nubs 14 are visible. In this configuration, the buds 14 are more prominent and generally conical in shape. Adjacent buds of a same square 15 are separated by finished stitching 13. A surface texture 5 is visible on the exterior side 1 of the squares. Assembled triplets 20 are combined into a final product as further described.

Figure 10:
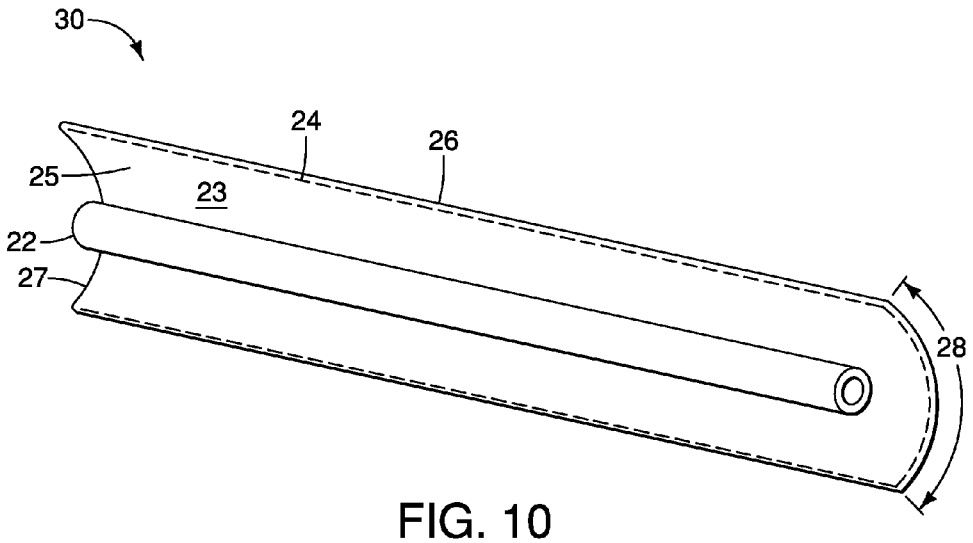
FIG. 10 illustrates components of a stem according to a first embodiment including a covering and a core.

FIG. 10 illustrates components of a stem 30 according to a first embodiment including a covering and a core. With reference to FIG. 10, a stem includes a core 22 that is wrapped in a covering 23 such as a fabric or other material such a green fabric with a pattern and texture reminiscent of a plant stem. For example, the covering 23 may be a green felt, green wool, green polyester, or patterned green-brown spandex. The fabric 23 includes a first edge 24 that runs substantially parallel to an axis defining the core 22. The covering 23 includes an inner surface 25 and an outer surface 26. The covering 23 includes a second or lateral side that is of a lateral dimension 28 sufficient to allow for at least one complete covering of the core 22. The covering 23 is shown as a single piece, but may take the form of multiple pieces assembled or formed to the core.

Figure 11:
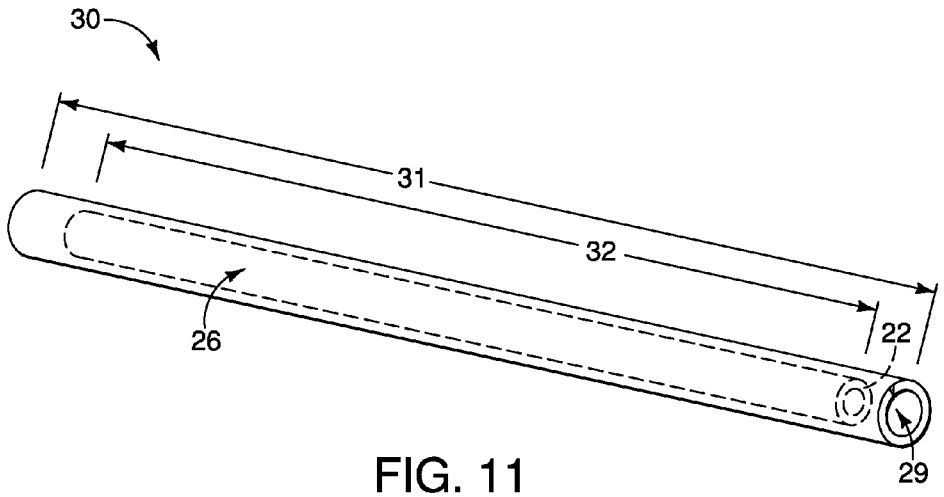
FIG. 11 illustrates a partially assembled stem.

FIG. 11 illustrates a partially assembled stem 30. The core 22 is wrapped with a covering 23. The core 22 is shown as a hollow core that forms a void or passage 29 through the center of the stem 30. When assembled, the covering 23 may be stitched to itself, to the core 22, or may be attached or assembled with a glue, rivets or other fastener or substance. Preferably, the covering 23 is of a greater length 31 than a length 32 of the core such that excess material that stretches beyond the ends of the core 22 may be wrapped over the ends. The outer surface 26 of the covering 23 is the only thing visible after the stem 30 has been formed.

Figure 12:
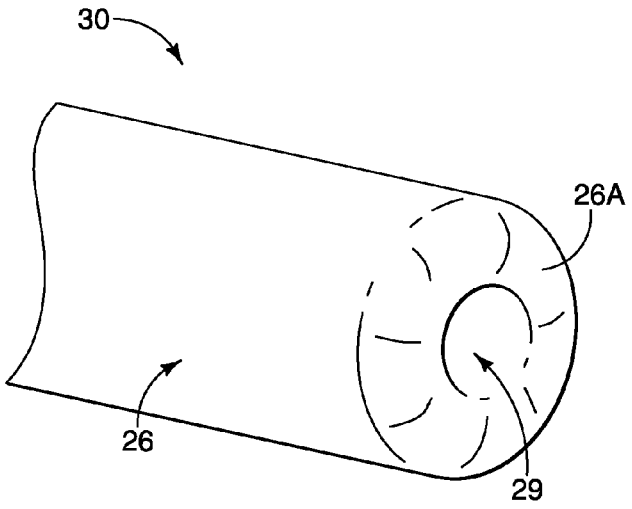
FIG. 12 illustrates a portion of a fully assembled stem according to a first embodiment.

FIG. 12 illustrates a portion of a fully assembled stem 30 according to a first embodiment. With reference to FIG. 12, an end of a stem 30 is wrapped in a covering 26. A void 29 is visible in the end of the stem 30. An end portion 26A of the covering has been folded over and tucked into the void 29. The end portion 26A may be attached with any fastener or means such as glue, hot glue, staples, stitching, plastic connectors, and the like.

Figure 13:
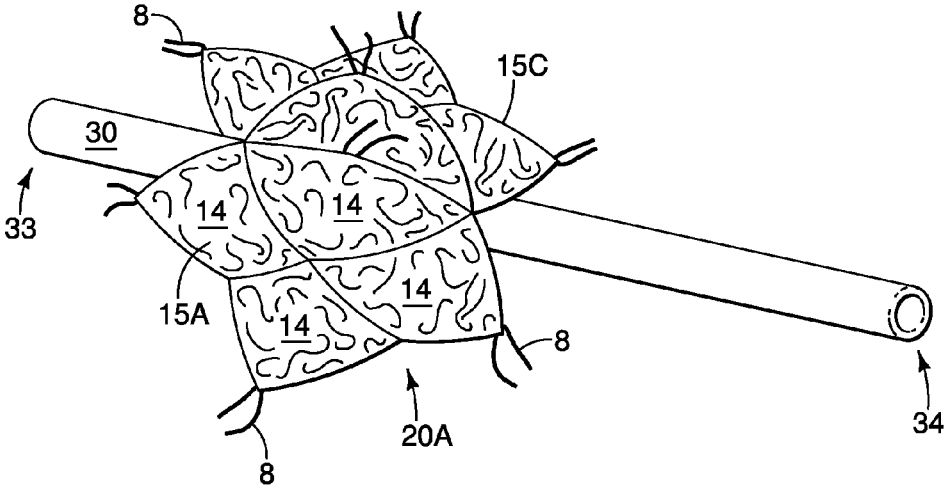
FIG. 13 illustrates a first triplet placed onto a stem according to a first embodiment of the invention.

FIG. 13 illustrates a first triplet 20A placed onto a stem 30 according to a first embodiment. With reference to FIG. 13, the stem 30 is placed through the first triplet 20A in a passage formed by the connected squares 15A, 15B and 15C. Each of the squares 15A, 15B and 15C is connected to the other two squares by bar tackings 17 or other means. Ornamental strings 8 are visible on the ends of the quadrants 14. The first triplet 20 may be placed anywhere along the length of the stem 30. According to an illustrative implementation, the first triplet 20A is placed at a proximal end 33 of the stem 30. The first triplet 20A is anchored to the stem 30 with one or more tacks, staples, rivets and the like. According to one specific illustrative technique, triplets are attached to a foam stem 30 with an Avery Dennison brand tacking or fastening tool (Fitchburg, Mass.). Such tool attaches two items together with one or more plastic-based fasteners. Each triplet 20 is securely fasten to the stem 30. Other triplets are added and fastened near or adjacent to the first triplet 20A on the stem 30 as further described next.

Figure 14:
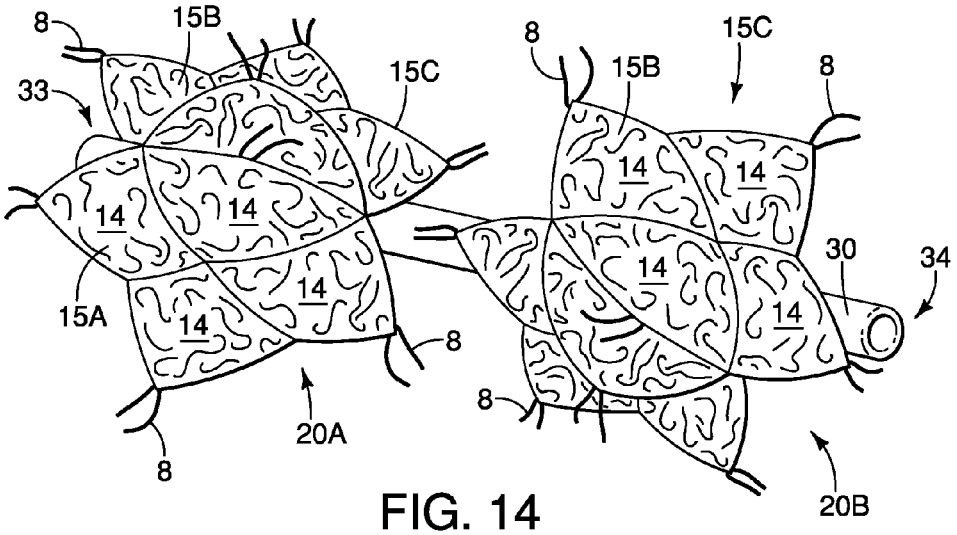
FIG. 14 illustrates a second triplet placed onto the assembly shown in FIG. 13.

FIG. 14 illustrates a second triplet 20B placed onto the assembly shown in FIG. 13. With reference to FIG. 14, the stem 30 is placed through the center of the second triplet 20B in a passage formed by the connected squares 15A, 15B and 15C. The squares 15A, 15B and 15C are connected to each other with bar stitchings 17 generally along a portion of the seams 13 toward the outer edge of each square 15A, 15B and 15C. As shown, the second triplet 20B is placed onto the distal end 34 of the stem 30 and subsequently slid into place (see FIGS. 15, 17). The second triplet 20B is rotated on the stem 30 through an angle of rotation (not labeled) such that quadrants 14 of the second triplet 20B nest into recesses between the quadrants 14 of the first triplet 20A when the second triplet 20B is pressed up against the first triplet 20A. That way, the nubs or quadrants 14 of the second triplet 20B and the nubs or quadrants 14 of the first triplet 20A blend seamlessly together to provide an appearance of nubs 14 seamlessly emanating from the stem 30 along the length of the stem 30. Once slid into place, the second triplet 20B is also anchored or attached to the stem 30 so that the second triplet 20B does not move after assembly. Following this pattern, further triplets are placed on the stem until a substantial portion of the stem 30 is covered from the proximal end 33 to the distal end 34.

Figure 15:
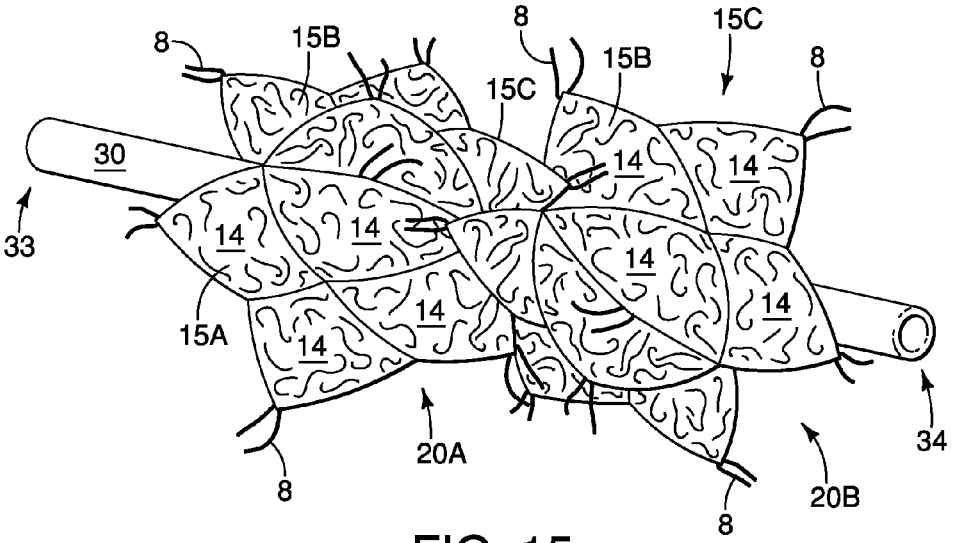
FIG. 15 illustrates the second triplet of FIG. 14 placed adjacent to the first triplet and placed in its final or assembled position.

FIG. 15 illustrates the second triplet of FIG. 14 placed adjacent to the first triplet and placed in its final or assembled position. With reference to FIG. 15, the stem 30 is placed through the center of the first triplet 20A and second triplet 20B in a passage formed by the connected squares 15A, 15B and 15C of the two triplets 20A, 20B. The second triplet 20B nests into recesses between the quadrants 14 of the first triplet 20A when the second triplet 20B is pressed up against the first triplet 20A along the axis of the stem 30. That way, the nubs or quadrants 14 of the second triplet 20B and the nubs or quadrants 14 of the first triplet 20A blend together to provide an appearance of nubs 14 seamlessly emanating from the stem 30 along the length of the stem 30. Following this pattern, further triplets are placed on the stem until a substantial portion of the stem 30 is covered from the proximal end 33 to the distal end 34.

Figure 16:
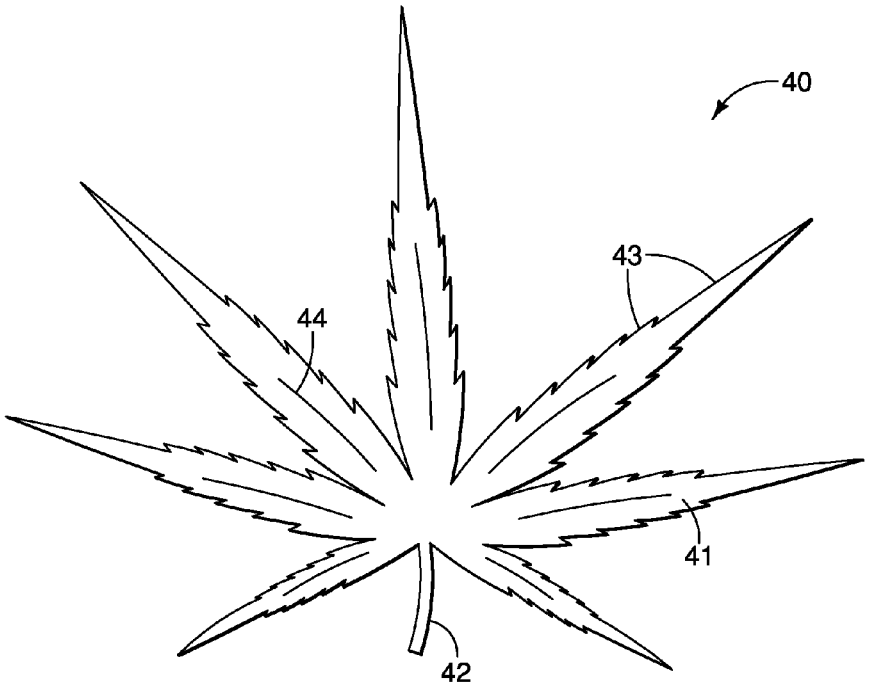
FIG. 16 illustrates an artificial *Cannabis* leaf for joining into an assembled set of triplets.

FIG. 16 illustrates an artificial *Cannabis* leaf 40 for joining into an assembled set of triplets 20. With reference to FIG. 16, a *Cannabis* leaf 40 includes distinctly shaped fronds 41 emanating from an end of a central stock 42. Each of the fronds 41 includes regions of jagged edges 43 and a central vein 44 along a central axis of each frond 41. While FIG. 16 is shown in black and white, it is to be understood that each leaf 40 is preferably made of a green material that is reminiscent of leaves of an actual *Cannabis* plant in terms of texture, pattern and one or more colors (e.g., hues). The size of each leaf 40 is selected so as to be consistent with the size of a nub or quadrant 14 as illustrated in other figures—not excessively varying from the size of the nubs 14.

Figure 17:
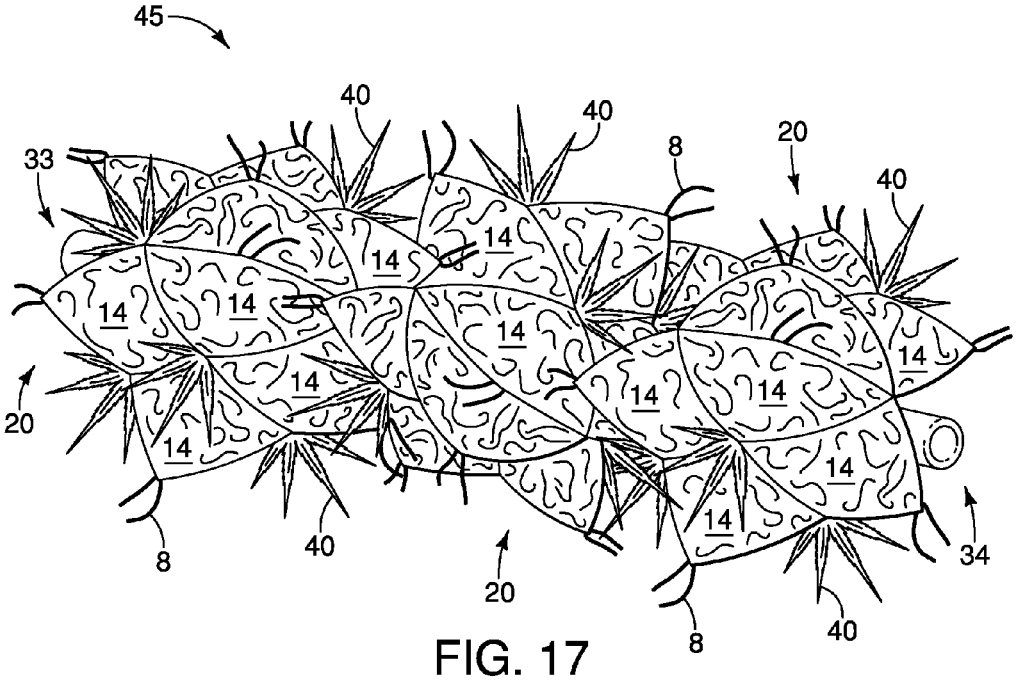
FIG. 17 illustrates a completed plush item assembled from components (e.g., triplets, stems and leaves).

FIG. 17 illustrates a completed plush item 45 assembled from components (e.g., triplets 20, stems 30 and leaves 40) according to a first illustrative embodiment of an artificial *Cannabis sativa* plant. With reference to FIG. 17, a mostly or completely finished plush item 45 includes a set of triplets 20 assembled onto and fastened to the stem 30. In a preferred implementation, either the proximal end 33 or the distal end 34 is covered with nubs or quadrants 14 with a triplet mounted substantially proximal to such end so as to obscure the end of the stem 30. The triplets 20 include nubs 14. A filament 8 is attached to an end of the nubs 14. During assembly both triplets 20 and leaves 40 are attached to the stem 30. Alternatively, the leaves 40 may be attached to the triplets 20.

The leaves 40 may individually be placed at random places between the nubs 14 and fastened to either the nubs 14 or other portion of the squares, or the leaves 40 may be attached directly to the stem 30 or the coating of the stem. Due to size restrictions, a certain number of triplets 20 are capable of being attached to a stem 30 of a certain size. An arbitrary but not excessive number of leaves 40 are added thereto to provide a natural appearance to the plush item 45. A proximal end 33 and distal end 34 of the stem 30 are visible at ends of the item 45. In a preferred implementation, either the proximal end 33 or distal end 34 of the stem 30 is not visible when the item 45 is fully assembled.

Figure 18:
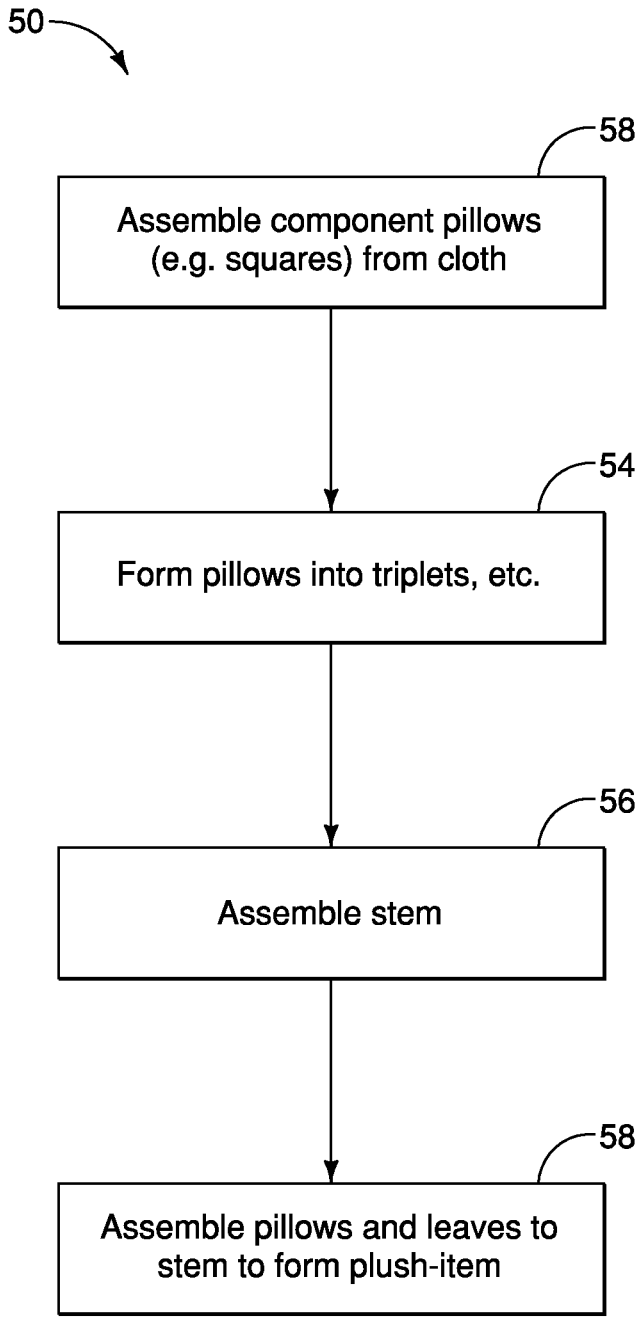
FIG. 18 is a flowchart of steps of a method for forming a plush item according to a first embodiment of the invention.

FIG. 18 is a flowchart of steps of a method 50 for forming a plush item (e.g., Teddy Bud) according to a first embodiment of the invention. With reference to FIG. 18, one step 52 includes assembling pillow components from cloth. For example, squares (shown completed in FIG. 5) are assembled by folding, stuffing, etc. Another step 54 includes forming squares into sets of squares (e.g., a triplet formed from assembling three pillows together, each pillow having plush buds). An example of a finished triplet is shown on a stem in FIG. 13. Another step 56 includes assembling a stem. Yet another step 58 includes forming a plush item (e.g., a finished pillow) by fastening sets of pillows to the stem and fastening artificial leaves to the stem or pillows. One set of pillows is nested up against and into another set of pillows. Thus, one triplet is nested up to and against another triplet so as to provide a substantially continuous set of buds along a length of the stem.

Conclusion. In the previous description, for purposes of explanation, numerous specific details are set forth in order to provide an understanding of the invention. It will be apparent, however, to one skilled in the art that the invention can be practiced without these specific details. In other instances, structures, devices, systems and methods are shown only in block diagram form in order to avoid obscuring the invention.

Reference in this specification to "one embodiment", "an embodiment", or "implementation" means that a particular feature, structure, or characteristic described in connection with the embodiment or implementation is included in at least one embodiment or implementation of the invention. Appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

It will be evident that the various modification and changes can be made to these embodiments without departing from the broader spirit of the invention. In an area of technology such as this, where growth is fast and further advancements are not easily foreseen, the disclosed embodiments may be readily modifiable in arrangement and detail as facilitated by enabling technological advancements without departing from the principles of the present disclosure.

I claim:

1. A method for assembling a plush replica of a plant, the method comprising:

forming sleeves of fabric from a sheet of material;

forming hollow buds in the sleeves of fabric by folding a portion of the fabric onto itself and stitching the fabric together along at least one stitching line;

filing the hollow buds with a filler to form filled pillows;

assembling at least two filled pillows together into a pillow assembly; and fastening at least two pillow assemblies to a stem to form the plush replica of a plant that includes filled buds.

2. The method of claim 1, and wherein the sleeves are substantially square in shape, and wherein four buds are formed in each sleeve.

3. The method of claim 2, and wherein assembling the pillow assembly includes fastening adjacent sleeves together along at least two regions on each sleeve.

4. The method of claim 1, and wherein the sheet of material is a fabric, and wherein the method further includes attaching a filament to at least one vertex of each pillow assembled to form the plush replica.

5. The method of claim 1, and wherein the at least two sleeves are assembled to form a passage in between the sleeves in the pillow assembly, and wherein a first pillow assembly is rotated with respect to a second pillow assembly when fastened to the stem so that the second pillow assembly is substantially nested against the first pillow assembly.

6. The method of claim 1, and wherein the stem is a hollow core pliable tube, and wherein the method further comprises covering the stem with a fabric prior fastening the said at least two pillow assemblies to the stem.

7. A plush pillowed item comprising:

a stem covered along its length with a fabric; and a plurality of pillow assemblies, and wherein each pillow assembly is formed from a plurality of pillows formed from sleeves of fabric, each pillow being formed into a plurality of pockets, and wherein the pockets are filled with a filler to form pillowed buds, and wherein each of the plurality of pillow assemblies is fastened as a unit to the stem.

8. The plush pillowed item of claim 7, and wherein each of the sleeves are substantially square in shape, and wherein four pockets are formed in each sleeve.

9. The plush pillowed item of claim 8, and wherein each pillow assembly is a triplet pillow assembly formed from three sleeves, and wherein adjacent sleeves are fastened together along at least two regions on each sleeve to form the triplet pillow assembly.

10. The plush pillowed item of claim 7, and wherein the sheet of material is a pile textile fabric, and wherein the plush pillowed item further comprises a filament attached to a plurality of vertices of the pillowed buds.

11. The plush pillowed item of claim 7, and wherein the pillows are assembled into a pillow assembly so as to form a passage in between the assembled pillows, and wherein a first pillow assembly is rotated with respect to a second pillow assembly when fastened to the stem so that the second pillow assembly is substantially nested against the first pillow assembly.

12. The plush pillowed item of claim 7, and wherein the stem is a hollow cored tube, and wherein the stem is made of a pliable material.

13. A plush item comprising:

sets of pockets formed from a quadrilateral portion of a sheet of material, and wherein the sheet of material includes a first texture on a first side and a second texture on a second side, and wherein pockets are separated by stitching;

a filler inserted into each of the pockets;

pocket assemblies each formed from at least two sets of pockets; and a stem, and wherein the filed pocket assemblies are mounted to the stem, and wherein pocket assemblies are mounted contiguously one against another to form a collection of pockets along the periphery of the stem.

14. The plush item of claim 13, and wherein a set of pockets includes four pockets formed from corners formed in the quadrilateral portion of the sheet of material.

15. The plush item of claim 13, and wherein the sets of pockets are fastened to each other along at least two portions on each set of pockets to form a pocket assembly.

16. The plush item of claim 13, the plush item further comprising:

a filament attached to a vertex of each of a plurality of the pockets.

17. The plush item of claim 13, and wherein the pocket assemblies are formed with a passage between the sets of pockets, and wherein the stem is received therein, and wherein a first pocket assembly is rotated with respect to a second pocket assembly when fastened to the stem so that the second pocket assembly is substantially nested against the first pillow assembly.

18. The plush item of claim 13, and wherein the stem includes a pliable tube and a fabric wrapped over and fastened to the stem.

19. The plush item of claim 13, and wherein each of the sets of pockets is formed by stitching along edges that are arranged as bifurcating seams that cross in a center region of the set of pockets; and wherein the plush item further includes artificial leaves mingled and attached within the pockets of the assembled plush item, and wherein the artificial leaves are approximately a same size as the filed pockets.

20. The plush item of claim 13, and wherein at least four pocket assemblies are mounted to the stem, and wherein one of two ends of the stem protrudes from the collection of pockets forming the plush item.

* * * * *